US009492919B2

(12) United States Patent
Roehm et al.

(10) Patent No.: US 9,492,919 B2
(45) Date of Patent: Nov. 15, 2016

(54) HANDHELD TOOL STORAGE DEVICE

(75) Inventors: Heiko Roehm, Stuttgart (DE); Tobias Herr, Stuttgart (DE); Georgios Margaritis, Schwieberdingen (DE); Joerg Welke, Ettlingen-Schoellbronn (DE)

(73) Assignee: ROBERT BOSCH GMBH, Stuttgart (DE)

( * ) Notice: Subject to any disclaimer, the term of this patent is extended or adjusted under 35 U.S.C. 154(b) by 361 days.

(21) Appl. No.: 13/489,639

(22) Filed: Jun. 6, 2012

(65) Prior Publication Data

US 2012/0312708 A1 Dec. 13, 2012

(30) Foreign Application Priority Data

Jun. 7, 2011 (DE) ..... 10 2011 077 112

(51) Int. Cl.

| | |
|---|---|
| ***B25H 3/02*** | (2006.01) |
| ***A45C 15/06*** | (2006.01) |
| ***A45C 11/20*** | (2006.01) |
| ***F21V 33/00*** | (2006.01) |
| *F21Y 105/00* | (2016.01) |

(52) U.S. Cl.

CPC ..... *B25H 3/021* (2013.01); *A45C 11/20* (2013.01); *A45C 15/06* (2013.01); *F21V 33/0084* (2013.01); *F21Y 2105/00* (2013.01); *F21Y 2105/001* (2013.01)

(58) Field of Classification Search

CPC ... A45C 15/06; A45C 11/20; F21V 33/0084; F21V 17/04

USPC ..... 206/207; 362/154–156

See application file for complete search history.

(56) References Cited

U.S. PATENT DOCUMENTS

| | | | | | |
|---|---|---|---|---|---|
| 5,344,339 | A | * | 9/1994 | Cheslock | 439/501 |
| 5,459,648 | A | | 10/1995 | Courtney | |
| 5,533,843 | A | * | 7/1996 | Chung | 408/241 R |
| 5,624,029 | A | | 4/1997 | Shih | |
| 5,685,421 | A | * | 11/1997 | Gilmore | 206/216 |
| 5,810,168 | A | * | 9/1998 | Eggering | 206/372 |
| 5,979,175 | A | | 11/1999 | Ellison | |

(Continued)

FOREIGN PATENT DOCUMENTS

| | | | |
|---|---|---|---|
| CN | 101614325 | A | 12/2009 |
| CN | 201471421 | U * | 5/2010 |

(Continued)

OTHER PUBLICATIONS

Cyclopedia: Or an Universal Dictionary of Arts and Sciences p. 449 Ephraim Chambers, 1728.*

(Continued)

*Primary Examiner* — Jong-Suk (James) Lee
*Assistant Examiner* — Christopher E Dunay
(74) *Attorney, Agent, or Firm* — Norton Rose Fulbright US LLP

(57) ABSTRACT

A handheld tool storage device, particularly to a handheld tool carrying case, having at least one base body unit which includes at least one movably supported base body element, and having at least one electric functional unit, and having at least one operating unit at least for operating the electric functional unit. The operating unit has at least one operating element that is at a minimum distance from an axis of motion of the base body element, which is less than 50% of a main extension of the base body element.

17 Claims, 3 Drawing Sheets

(56) References Cited

U.S. PATENT DOCUMENTS

| | | | | |
|---|---|---|---|---|
| 6,254,251 | B1 | 7/2001 | Washington | |
| 6,981,780 | B2 * | 1/2006 | Einav | 362/154 |
| 7,559,674 | B2 * | 7/2009 | He et al. | 362/249.02 |
| 7,628,271 | B1 * | 12/2009 | Marton | 206/320 |
| 7,806,271 | B1 * | 10/2010 | Kraska | 206/542 |
| 8,604,752 | B2 * | 12/2013 | Cole et al. | 320/114 |
| 2003/0142491 | A1 * | 7/2003 | Kwak | 362/205 |
| 2004/0228114 | A1 * | 11/2004 | Chen | 362/84 |
| 2005/0156564 | A1 * | 7/2005 | Krieger | 320/112 |
| 2007/0103892 | A1 | 5/2007 | McDaniel et al. | |
| 2007/0258236 | A1 * | 11/2007 | Miller | 362/205 |
| 2009/0323361 | A1 * | 12/2009 | Liu | 362/373 |

FOREIGN PATENT DOCUMENTS

| | | | |
|---|---|---|---|
| CN | 101947704 | A | 1/2011 |
| DE | 10 2009 027 573 | A1 | 1/2011 |
| TW | 200424043 | A | 11/2004 |

OTHER PUBLICATIONS

EPO Machine Translation of CN 201471421 U.*

Lidar (Light Detection and Ranging)—Wikipedia, the free encyclopedia, (2012), pp. 1-10, XP055256519.

* cited by examiner

HANDHELD TOOL STORAGE DEVICE

RELATED APPLICATION INFORMATION

The present application claims priority to and the benefit of German patent application no. 10 2011 077 112.3, which was filed in Germany on Jun. 7, 2011, the disclosure of which is incorporated herein by reference.

FIELD OF THE INVENTION

The present invention relates to a handheld tool storage device, particularly to a handheld tool carrying case, having at least one base body unit which includes at least one movably supported base body element, and having at least one electric functional unit, and having at least one operating unit at least for operating the electric functional unit

BACKGROUND INFORMATION

Handheld tool storage devices, particularly handheld tool carrying cases are believed to be understood, which include a base body unit having a movably supported base body element, an electric functional unit and an operating unit for operating the electric functional unit.

SUMMARY OF THE INVENTION

The exemplary embodiments and/or exemplary methods of the present invention relate to a handheld tool storage device, particularly to a handheld tool carrying case, having at least one base body unit which includes at least one movably supported base body element, having at least one electric functional unit and having at least one operating unit at least for operating the electric functional unit. It is provided that the operating unit have at least one operating element that is at a minimum distance from an axis of motion of the base body element, which is smaller than 50% of the main extension of the base body element. The handheld tool storage device may be configured as a handheld tool carrying case, the base body unit may be including at least one movably supported base body element that is configured as a carrying case cover, and an additional base body element configured as a carrying case base body. By "carrying case base body" one should understand, in this instance, in particular, a base body element of the base body unit of the handheld tool storage device configured as a handheld tool carrying case, which includes an accommodation region in which at least one handheld machine tool and/or accessories for the handheld machine tool is able to be situated for transport and/or for storage.

A handheld machine tool that is able to be positioned in the accommodation region may be configured, for instance, as a drilling machine, as a drilling and/or chisel hammer, as a sawing machine, as a planing machine, as an electric screw driver, as a portable milling machine, as a portable grinding machine, as a multifunctional machine, as a gardening tool and/or as another handheld machine tool that would appear useful to one skilled in the art. Accommodation elements especially may be situated in the accommodation region of the carrying case base body, which are provided to accommodate at least partially, in a form-locking manner, a handheld machine tool and/or accessories for the handheld machine tool. In this connection, the accommodation elements have at least one accommodation recess that corresponds to the outer contour of a handheld machine tool that is to be accommodated and/or to the outer contours of accessories that are to be accommodated.

By "provided" one should understand particularly specially designed and/or specially equipped.

By a "carrying case cover" one should understand, in this instance, especially a base body element of the base body unit of the handheld tool storage device configured as a handheld tool carrying case, which is provided, at least in a closed state of the handheld tool carrying case, to cover the accommodation region of the carrying case base body, at least for the most part and especially completely. The carrying case cover may be supported in a relatively movable manner with respect to the carrying case base body. The carrying case may be connected to the carrying case base body detachably, in this instance, by an operator in a manner especially free from destruction and the use of a tool. For positioning into and for taking out a handheld machine and/or accessories for the handheld machine tool in and/or out of the accommodation region, in an orderly handling, the handheld tool carrying case may be put down, using a contact surface of the carrying case base body, onto a surface of a work table, on a working area, etc. The contact surface, in this instance, is particularly situated on a side of the carrying case base body facing away from the accommodation region. It is also conceivable, however, that the handheld tool storage device have another embodiment that appears useful to one skilled in the art, such as an embodiment as a handheld tool chest, as a handheld tool workshop wagon, etc. The expression "electric functional unit" should particularly specify a unit, in this case, which includes at least one electrical and/or electronic component.

The electronic functional unit may be provided for reproducing optical, acoustical and/or tactile data and/or for emitting electromagnetic waves. The electric functional unit may be configured, for example, as an audio reproduction unit, a video reproduction unit, as an illuminating unit or as another electric functional unit that would appear useful to one skilled in the art. By "operating unit" one should understand, in this instance, a unit provided for changing a state of a superordinated unit of the operating unit as a result of an operation of at least the operating element. The operating unit at least may be provided for having an operator switch on and/or off the electric functional unit as a result of operating an operating element. The operating element is connected at least electrically to an energy supply unit, in this instance. In this instance, the operating element may be configured as a toggle switch, as a push-button switch, as a rotary switch and/or as another operating element appearing useful to one skilled in the art. In a closed state of the handheld tool carrying case, the operating element, in this instance, may be situated on the carrying case cover on the side facing away from the accommodation region. It is also conceivable, however, that the operating element might be situated at another position appearing useful to one skilled in the art, such as in the accommodation region of the carrying case base body, etc. In addition, the operating element may be configured, for instance, as a remote operation, which is able to be fastened on the carrying case cover and/or on the carrying case base body, using a form-locking and/or a force-locking connection. It is also conceivable, however, that the operating element might be configured as a receiver for remote operation.

The expression "minimum distance" should here specify particularly a distance, running as seen along a direction at least essentially perpendicular to an axis of motion of the base body element, between two elements, particularly between the operating element and the axis of motion and/or an energy store interface of an energy supply unit of the handheld machine tool storage device and the axis of motion, which, with respect to a value of a measurement of the distance between the two elements, takes on the smallest value. Consequently, the minimum distance may be specified by a length of a straight line, running at least essentially perpendicular to the axis of motion, between a point on the axis of motion and a point of the operating element and/or of the energy store interface that is closest to the axis of motion. The operating element particularly has a minimum distance from the axis of motion that is less than 20 cm, which may be less than 10 cm and especially may be less than 5 cm. The expression "essentially perpendicular" is here supposed to specify particularly an alignment of a direction relative to a reference direction, the direction and the reference direction, especially as seen in a plane, including an angle of 90°, and the angle having a maximum deviation of particularly less than 8°, advantageously less than 5° and particularly advantageously less than 2°.

By a "main extension of the base body element" one should, in particular in this case, understand a maximum extension of the base body element, especially of the carrying case cover, which in a plane that includes the axis of motion, runs at least essentially parallel to the axis of motion. By "essentially parallel" one should understand, in this instance, especially an alignment of a direction relative to a reference direction especially in a plane, the direction having a deviation with respect to the reference direction especially less than 8°, advantageously less than 5° and particularly advantageously less than 2°. Using the embodiment according to the present invention of the handheld tool storage device, one may advantageously achieve a compact positioning of the operating element. Furthermore, one may advantageously ensure a comfortable accessibility of the operating element by an operator.

The operating element advantageously has a minimum distance from an axis of motion, which is less than 25% of the main extension of the base body element. Consequently, a compact positioning of the operating element may be achieved particularly advantageously in the vicinity of an axis of motion. Connecting lines for connecting the operating element to elements that cooperate with the operating element may, with regard to their length, be designed advantageously short.

In addition, it is provided that the handheld tool storage device include at least one energy supply unit, which is provided to supply at least the electric functional unit with energy, at least in an operating state. In a particular manner, using a cooperation of the energy supply unit and the operating unit, by operating the operating element, an energy supply of the electric functional unit may be prevented and/or produced. The energy supply unit may have at least one power cord that is provided to connect to a stationary current network, in order to supply the electric functional unit with electrical energy, at least in an operating state. Consequently, the energy supply unit may be connected functionally to the electric functional unit. An energy supply of the electric functional unit may advantageously be achieved.

Furthermore, it is provided that the energy supply unit includes at least one energy store interface, which, along with at least one energy store device, is able to be connected to form an energy supply of the electric functional unit, that is network-independent at least in an operating state. The energy store device is advantageously configured as a rechargeable battery pack accumulator. The battery pack may be configured as a battery pack that can be taken out of, and/or detached from a battery pack-driven handheld machine tool. Thus, the energy store device configured as a battery pack may be used in the energy supply unit and/or in a handheld machine tool stored and/or transported in the handheld tool storage device. It is also conceivable, however, that the energy store device has another embodiment appearing useful to one skilled in the art. The energy store device configured as a battery pack may be able to be charged in a state connected to the energy store interface, in a network operation implemented using a power cord of the energy supply unit, by a charging unit of the energy supply unit. The handheld tool storage device may include at least one energy storage device, which is able to be connected to the energy store interface. A network-independent energy supply may advantageously be achieved, particularly a network-independent energy supply of the electric functional unit. Consequently, the electric functional unit may be utilized advantageously at work sites at which no network supply is available or the distance between an interface of the network supply, in particular a socket outlet of the network supply, and the energy supply unit is greater than the length of the power cord of the energy supply unit.

The energy store interface may have a minimum distance from an axis of motion of the base body element, which is less than 50% of the main extension of the base body element. The energy store interface particularly has a minimum distance from the axis of motion that is less than 20 cm, which may be less than 10 cm and especially may be less than 5 cm. Consequently, one may advantageously situate a gravitational center of the base body element in the vicinity of the axis of motion.

In addition, it is provided that the operating element be situated on a side of the base body element that is facing away from the side of the base body element at which the energy store interface is situated on the base body element. A short connecting line between the operating element cooperating with the energy store interface and the energy store interface may advantageously be implemented The electric functional unit is advantageously configured as an illuminating unit. By "illumination unit" one should understand, in this case, particularly a unit which has at least one illumination arrangement and may have at least one optical system, particularly an optical system for scattering the light generated by the at least one means of illumination. In this instance, the means of illumination may be configured as an incandescent lamp, as a gas lamp, as a phosphor lamp, as an LED and/or as another means of illumination appearing useful to one skilled in the art. The illuminating unit may have a plurality of means of illumination configured as LED's. Using the embodiment according to the present invention of the handheld tool storage device, one may advantageously illuminate a work region using the illuminating unit. Consequently, a high degree of working comfort may be achieved for the operator.

Furthermore, it is provided that the illuminating unit have at least one cooling element for cooling an arrangement of illumination of the illuminating unit. A "cooling element" should be understood particularly to be provided to carry off heat from the arrangement of illumination, and to release it to the surrounding air. The cooling element may have at least two cooling ribs. During operation, the cooling ribs may be provided to cool the temperature of a surface of the cooling element to less than 80 degrees, advantageously less than 60 degrees, especially advantageously less than 40 degrees above the surrounding air. The cooling element may be made at least of a material having a thermal conductivity greater than 100 W/mK, especially may be greater than 200

W/mK. For heat transport, the cooling element has at least copper, at least one heat pipe and/or particularly advantageously at least aluminum. By the expression "for cooling the arrangement of illumination" one should understand that the cooling element and the arrangement of illumination are connected especially in a heat-conductive manner. The cooling element and the arrangement of illumination are connected in a heat-conductive manner appearing useful to one skilled in the art. The removal of heat from a arrangement of illumination of the illuminating unit may be advantageously achieved.

The cooling element may be situated on the base body element. The expression "situated on" is particularly supposed to specify, in this case, the situation of a component relative to a further component, the component being able to be fixedly connected with one region to the further component and/or the component, in a mounted state, being at least completely surrounded by the further component on at least two sides, and being situated particularly in a recess of the further component. The cooling element together with the arrangement of illumination of the illuminating unit may be situated on the base body element configured as carrying case cover. Heat emission to the air surrounding the base body element may advantageously be achieved.

It is also provided that the base body element be supported in a pivotable manner. The handheld tool storage device may have at least one fixing device that is provided for fixing the base body element in various positions relative to an additional base body element that is configured as a carrying case base body. By "fixing device" one should particularly understand, in this case, a device provided to hold the base body element in at least a position desired by an operator, using a form-locking and/or a force-locking connection. The fixing device may be configured as a snap-in rail, having a plurality of snap-in recesses into which a spring-prestressed snap-in element is able to engage and/or as an overlatch device that is situated directly in bearing regions of the base body element. It is also conceivable, however, that the energy store device has another embodiment appearing useful to one skilled in the art. Using the pivotable support of the base body element, a comfortable access possibility to the accommodation region of the carrying case base body can be achieved. Moreover, using the fixing device, a reliable positioning of the base body element with respect to the further base body element is able to be achieved.

The handheld tool storage device should not thereby be restricted to the application and the execution described above. In particular, the handheld tool storage device according to the present invention, in order to fulfill a method of functioning described here, may have a number that differs from the number, named herein, of individual elements, components, units and devices.

Further advantages are derived from the description of the figures that follow. The drawings show an exemplary embodiment of the present invention. The drawings, the description, and the claims include numerous features in combination. One skilled in the art will expediently also consider the features individually, and will combine them into useful further combinations.

DETAILED DESCRIPTION

Figure 1:
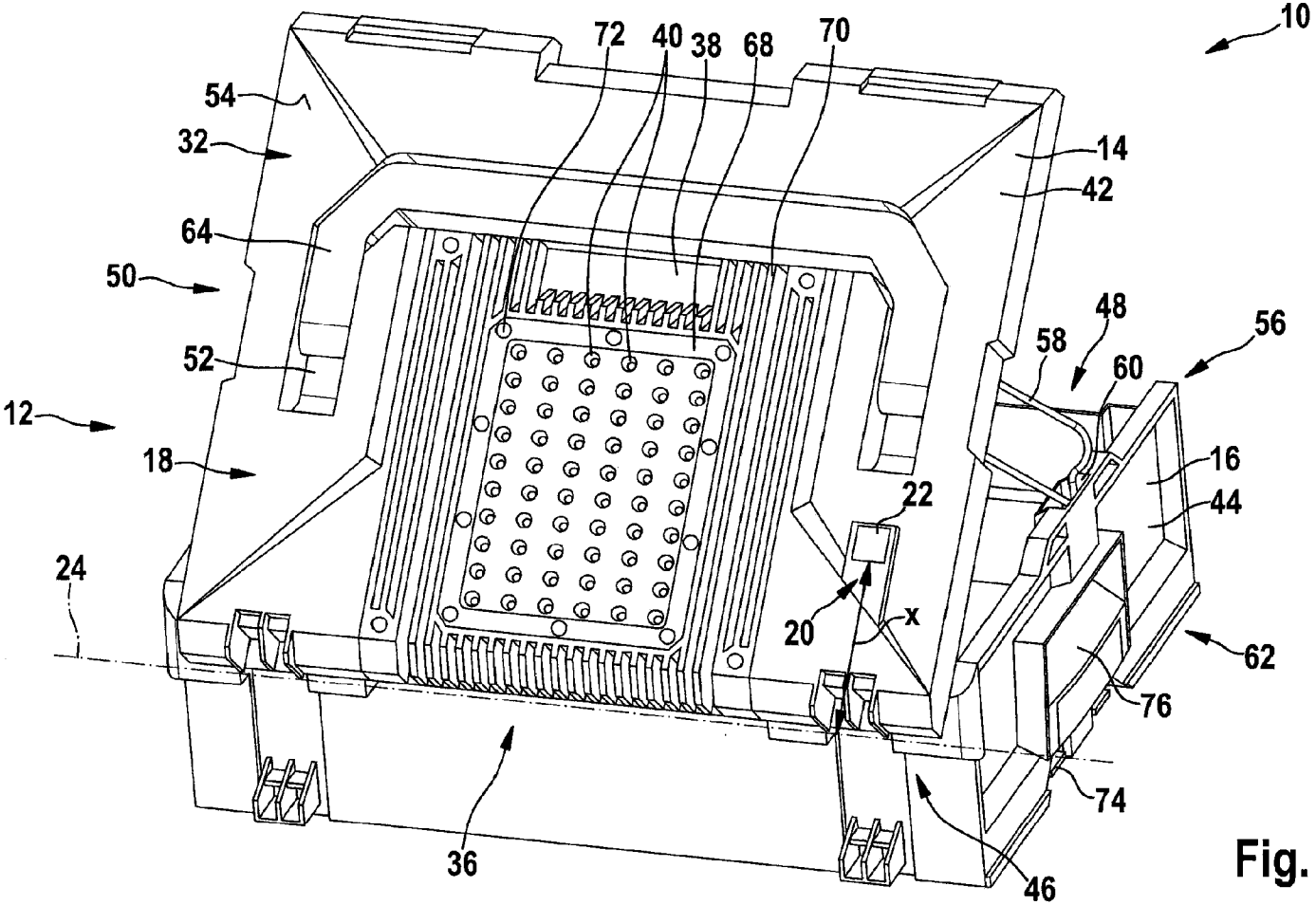
FIG. 1 shows an handheld tool storage device according to the present invention in an open state, yielding a view onto an electric functional unit of the handheld tool storage device, in a schematic representation.

FIG. 1 shows an handheld tool storage device 10 configured as an handheld tool carrying case in an open state. The handheld tool storage device 10 configured as an handheld tool carrying case includes a base body unit 12, an electric functional unit 18 and an operating unit 20 for operating electric functional unit 18. Base body unit 12 has a base body element 14 that is configured as a carrying case cover 42 and is supported movably, and an additional base body element 16 configured as a carrying case base body 44. Base body element 14 configured as carrying case cover 42 base body unit 12, using a support unit 46 of base body unit 12, is pivotable about an axis of motion 24 configured as a pivoting axis, of base body element 14, on the additional base body element 16 that is configured as carrying case base body 44.

Carrying case base body 44 is provided to accommodate a handheld machine tool (not shown in greater detail here) and/or accessories (not shown in greater detail here) of the handheld machine tool, in a manner known to one skilled in the art, in accommodation elements (not shown in greater detail here) of carrying case base body 44, which are situated in an accommodation region 48 of the carrying case base body 44.

Carrying case cover 42 is provided to cover and to close accommodation region 48 in a manner that is known to one skilled in the art. Between carrying case cover 42 and carrying case base body 44, there is situated, in this case, a sealing arrangement (not shown in greater detail here) in a manner known to one skilled in the art. The sealing arrangement may be configured as a labyrinth seal and/or as another sealing arrangement appearing useful to one skilled in the art. In this instance, the sealing arrangement is situated at a closing surface of carrying case cover 42 to carrying case base body 44. When carrying case cover 42 is closed, the sealing arrangement has a sealing effect according to protective Class IP 52 between carrying case base body 44 and carrying case cover 42. Because of this, penetration of dirt and moisture into the accommodation region of carrying case base body 44 is prevented to the greatest extent.

Figure 2:
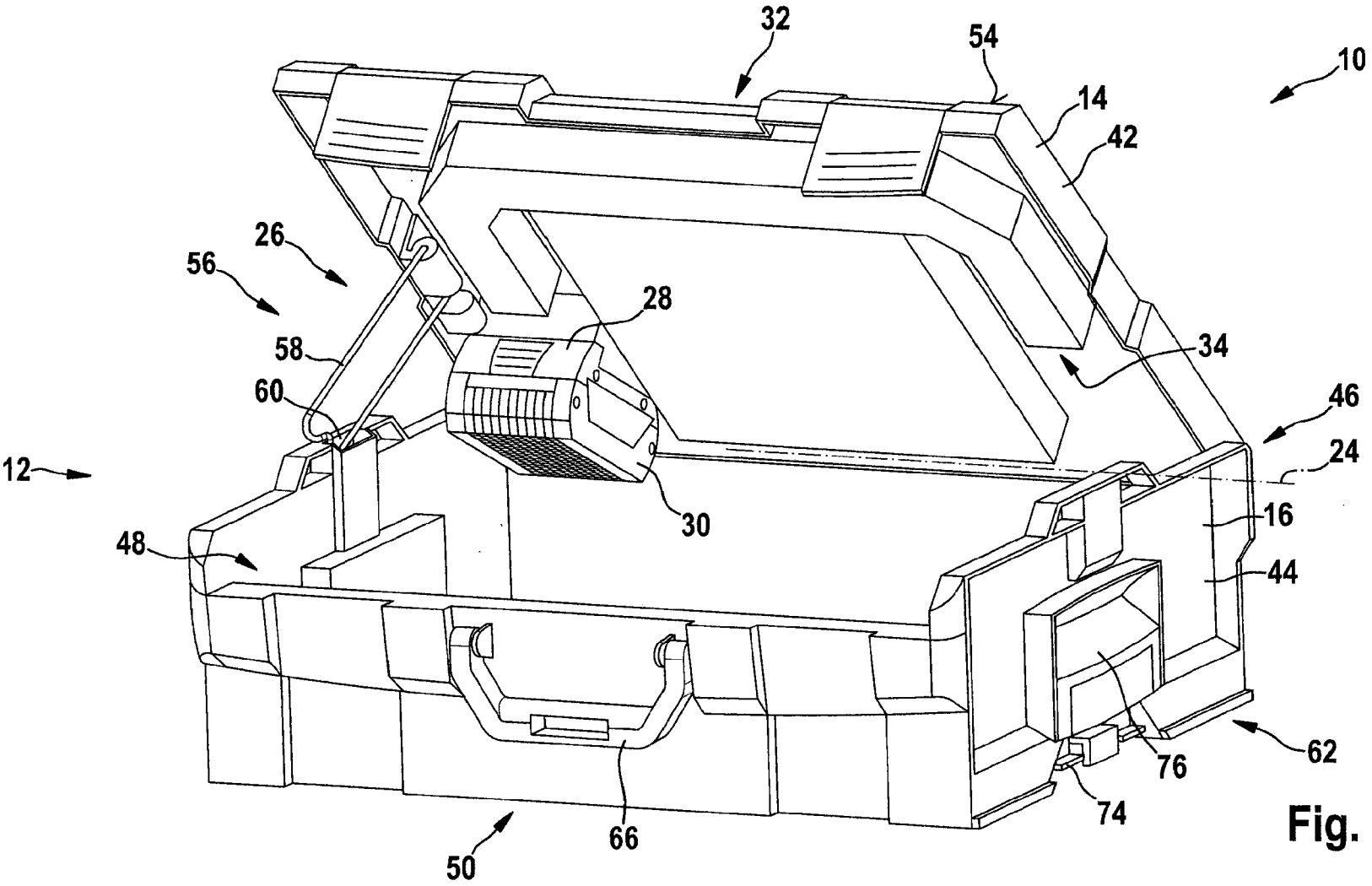
FIG. 2 shows the handheld tool storage device according to the present invention in an open state, yielding a view onto an accommodation region of the handheld tool storage device, in a schematic representation.

In addition, handheld tool storage device 10, configured as an handheld tool carrying case, has a fixing device 56 that is provided to fix carrying case cover 42 in at least one position relative to base body unit 12 (see FIG. 2). Fixing device 56 includes a support element 58 which is supported movably on carrying case cover 42. In an open state of the handheld tool carrying case, support element 58 is able to be fixed in a latching recess 60 of carrying case base body 44. In this instance, latching recess 60 has an embodiment corresponding to support element 58. Support element 58 is configured as a metal holder. It is also conceivable, however, that fixing device 56 has another embodiment appearing useful to one skilled in the art. For example, fixing device may have more than one support element 58 and/or support element 58 may be configured as a latchable, telescoping rod-like support element. Furthermore, an embodiment of support element 58 as a gas pressure damper, etc., is also conceivable.

Furthermore, handheld tool storage device 10 has a handle unit 50 situated on one of base body elements 14, 16 of base body unit 12. Handle unit 50 has two handle elements 64, 66. One of handle units 64, 66 is situated on base body element 14 that is configured as carrying case cover 42, and one of handle elements 64, 66 is situated on additional base body element 16 that is configured as carrying case base body 44. Each of handle elements 64, 66 is supported movably relative to base body unit 12. In this instance, handle elements 64, 66 are each supported relative to base body unit 12 pivotably on carrying case cover 42 and on carrying case base body 44. Carrying case cover 42 has an accommodation recess corresponding to an outer contour of handle element 64 situated on carrying case cover 42. Accommodation recess 52 is provided to accommodate essentially completely handle element 64, that is situated on carrying case cover 42, in a state of being pivoted in. In the state of being pivoted in, handle element 64, that is situated on carrying case cover 42, closes essentially flush with an outer surface 54 of carrying case cover 42 that faces away from carrying case base body 44, using a side 34 facing away from carrying cases cover 42 of handle element 64 situated on carrying case cover 42.

Operating unit 20 of handheld tool storage device 10 has an operating element 22, which is at a minimum distance x from axis of motion 24 of base body element 14 that is configured as carrying case cover 42, and which is smaller than 50% of a main extension of base body element 14. Minimum distance x from axis of motion 24 of base body element 14 may be less than 25% of the main extension of base body element 14. In this instance, operating element 22 is situated in a region of carrying case cover 42 which, as seen in a direction that runs along at least essentially perpendicular to the axis of motion 24, between handle element 64 and support unit 46 of base body unit 12. Operating element 22 is configured as a rubberized pressure switch, which is situated in a recess of outer surface 54 of carrying case cover 42. It is also conceivable, however, that operating element 22 has another embodiment appearing useful to one skilled in the art. In addition, as seen in a direction running along at least essentially parallel to axis of motion 24 and facing away from carrying case cover 42, operating element 22 is at a distance from an edge region bordering outer surface 54 of carrying case cover 42, that is less than 25% of the main extension of base body element 14.

For the energy supply of electric functional unit 18, handheld tool storage device 10, configured as an handheld tool carrying case, has an energy supply unit 26. Energy supply unit 26 includes a power cord (not shown here in greater detail), which is able to be connected to a current network, a power pack (not shown here in greater detail) and a cord extension (not shown here in greater detail). The power cord, the power pack and the cord extension are situated in carrying case base body 44. Furthermore, the power cord and the power pack are provided for energy supply to take up and transport energy from a current network during a network operation. The power pack converts various network voltages to direct current, in a manner known to one skilled in the art, which, during network operation, transmits electric power to electric functional unit 18. The cord extension is provided for pulling the power cord into carrying case base body 44 as a result of triggering by an operator.

Figure 3:
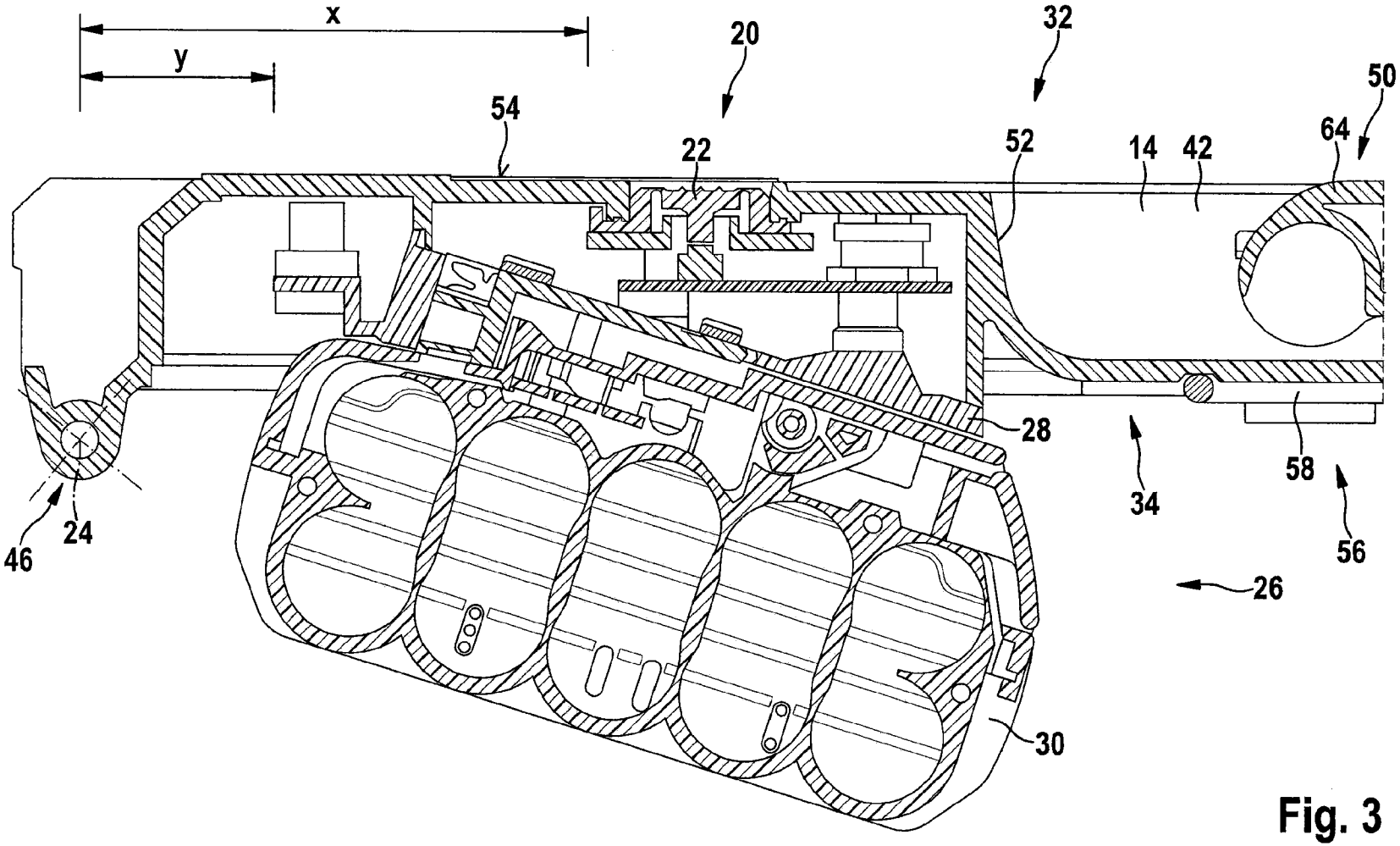
FIG. 3 shows a detailed view of an arrangement of an operating element of an operating unit and an energy store device of the handheld tool storage device, in a schematic representation.

Furthermore, energy supply unit 26 includes an energy store interface 28 which, in an operating state, is able to be connected to an energy store device 30, to form a network-independent energy supply of electric functional unit 18. Energy store interface 28 is situated on base body element 14 of base body unit 12 which is configured as carrying case cover 42. In this case, operating element 22 is situated on a side 32, of base body element 14 configured as carrying case cover 42, which faces away from side 34 of base body element 14 configured as carrying case cover 42, on which energy store interface 28 is situated on the base body element configured as carrying case cover 42. It is also conceivable, however, that energy store interface 28 might be situated on further base body element 16 configured as carrying case base body 44. An imaginary straight line running at least essentially perpendicular to outer surface 54 of carrying case cover 42 intersects, in this case, operating element 22 and energy store interface 28. Consequently, operating element 22 and energy store interface 28 are situated in a plane running at least essentially perpendicular to outer surface 54, and the plane runs at least essentially perpendicular to the axis of motion 24 of carrying case cover 42 (FIG. 3). The plane running perpendicular to axis of motion 24 of carrying case cover 42 intersects operating element 22, energy store interface 28 and energy store device 30 in a mounted state.

Energy store interface 28 is at a minimum distance from axis of motion 24 of base body element 14 configured as carrying case cover 42, which is less than 50% of the main extension of base body element 14 (FIG. 3). Energy store interface 28 may be at a minimum distance y from axis of motion 24 of base body element 14 configured as carrying case cover 42, which is less than 25% of the main extension of base body element 14 (FIG. 3). Handheld tool storage device 10 configured as an handheld tool carrying case also includes energy store device 30, which is configured as a battery pack. Energy store device 30 is compatible, in this case, with an handheld machine tool that is able to be situated in handheld tool storage device 10 configured as an handheld tool carrying case. Consequently, energy store device 30 is able to be utilized for the operation of an handheld machine tool and/or for the energy supply of electric functional unit 18. Energy supply unit 26 is connected to operating element 22 of operating unit 20, using electric lines (not shown here in greater detail) in a manner known to one skilled in the art. Operating element 22 and energy supply unit 26 are situated in an electric circuit in which electric functional unit 18 is situated.

Electric functional unit 18 may be switched on and/or off using operating element 22 of operating unit 20. Consequently, the electric circuit for the energy supply of electric functional unit 18 may be interrupted and/or closed by an operation of operating element 22. Electric functional unit 18 is configured as an illuminating unit 36. Illuminating unit 36 has a cooling element 38 for cooling arrangement of illumination 40 of illuminating unit 36. Arrangement of illumination 40 are configured as light-emitting diodes. Cooling element 38, together with the arrangement of illumination 40, may be situated on base body element 14 that is configured as carrying case cover 42. Illuminating unit 36 also has a pane that covers arrangement of illumination 40 in a protective manner. One surface of the pane forms an illumination area of arrangement of illumination 40. The illumination area is larger than 200 $cm^2$. During operation, cooling element 38 cools arrangement of illumination 40 of illuminating unit 36. Cooling element 38 encloses arrangement of illumination 40 in a plane, over 360°.

Between cooling element 38 and arrangement of illumination 40 there is a sealing element 68. Sealing element 68 also encloses arrangement of illumination 40 in the plane, over 360 degrees. Sealing element 68 protects arrangement of illumination 40 from dust and moisture. Cooling element 38 has a plurality of cooling ribs 70. Cooling element 38 is made of aluminum. Arrangement of illumination 40 is situated completely in one recess of carrying case cover 42. Cooling element 38 is permanently connected to carrying case cover 42, in this instance. Cooling element 38 is screwed to the carrying case cover using fastening elements 72 configured as screws. The fastening elements 72 configured as screws are screwed in for fixing cooling element 38, and thus arrangement of illumination 40 on carrying case cover 42, starting from side 32 of carrying case cover 42 facing away from carrying case base body 44. However, it is also conceivable that fastening elements 72 might be screwed into carrying case cover 42 from another side appearing meaningful to one skilled in the art. Cooling element 38 has a projection area that is larger than 300 $cm^2$. The projection area is aligned at least essentially parallel to outer surface 54 of carrying case cover 42.

Furthermore, handheld tool storage device 10 configured as handheld tool carrying case includes a stacking device 62 that is provided to produce at least a form-locking connection when stacking is performed, by which the forces acting at least in a stacking plane are able to be transmitted. Stacking device 62 has form-locking elements 76 and latching elements 74 that are provided to make possible an at least essentially non-displaceable stacking, when stacking of handheld tool storage device 10 on an additional handheld tool storage device takes place. Form-locking elements 76 and latching elements 74 act, in this case, in a manner known to one skilled in the art, together with form-locking elements and latching elements of the additional handheld tool storage device, which are configured in a corresponding manner to form-locking elements 76 and latching elements 74 of handheld tool storage device 10. Consequently, stacking device 62 is provided to produce a force-locking connection in addition to producing a form-locking connection when stacking is performed. Stacking device 62 is situated on two sidewalls of carrying case base body 44.

What is claimed is:

1. A handheld tool storage device, comprising:

at least one base body unit, which includes at least one movably supported base body element that is configured as a carrying case cover and a carrying case base body including an accommodation region for accommodating at least one handheld machine tool;

at least one electric functional unit; and at least one operating unit at least for operating the at least one electric functional unit, wherein the operating unit has at least one operating element that is at a minimum distance from an axis of motion of the base body element, which is less than 50% of the main extension of the base body element, wherein the main extension of the base body element is the maximum extension of the base body element, which in a plane that includes the axis of motion, runs at least essentially parallel to the axis of motion, wherein:

an energy supply unit includes at least one energy store interface, which, along with at least one energy store device embodied as a battery pack for a handheld machine tool, is connectable to form an energy supply of the electric functional unit that is network-independent at least in an operating state, the at least one operating element is situated on an outer surface of the base body element that faces away from an inner surface of the base body element at which the energy store interface is situated on the base body element such that the battery pack connected to the energy store interface is disposed in the accommodation region, wherein the at least one operating element is separated from the energy store interface by the base body element, and the at least one operating element is situated on opposite sides of the base body element in relation to the energy store interface, the at least one electric functional unit is configured as an illuminating unit, the illuminating unit has at least one cooling element for cooling an illumination arrangement of the illuminating unit, the illuminating unit is situated on an outer surface of the base body element, the cooling element and the illumination arrangement are permanently connected to the base body element, the cooling element includes a projection area that is essentially parallel to the outer surface of the base body element, and the illumination arrangement comprises an illumination area that is essentially perpendicular to the outer surface of the base body element, an imaginary straight line runs at least essentially perpendicular to the outer surface of the base body element and intersects the at least one operating element and the at least one energy store interface.

2. The handheld tool storage device of claim 1, wherein the operating element is at a minimum distance from the axis of motion of the base body element, which is less than 25% of the main extension of the base body element.

3. The handheld tool storage device of claim 1, further comprising:

at least one energy supply unit, which is provided for supplying at least the electric functional unit with energy, at least in an operating state.

4. The handheld tool storage device of claim 1, wherein the energy store interface is at a minimum distance from the axis of motion of the base body element, which is less than 50% of a main extension of the base body element.

5. The handheld tool storage device of claim 1, wherein the cooling element is situated on the base body element.

6. The handheld tool storage device of claim 1, wherein the base body element is supported in a pivotable manner.

7. The handheld tool storage device of claim 1, wherein the handheld tool storage device is a handheld tool carrying case.

8. The handheld tool storage device of claim 1, wherein the operating element is configured as a rubberized pressure switch, which is situated in a recess of an outer surface of the base body element, wherein the operating unit switches the electric functional unit on and off.

9. The handheld tool storage device of claim 1, wherein the cooling element comprises at least two cooling ribs.

10. The handheld tool storage device of claim 1, wherein the illumination arrangement includes a plurality of light-emitting diodes.

11. The handheld tool storage device of claim 1, further comprising:

a sealing element that is situated between the cooling element and the illumination arrangement.

12. The handheld tool storage device of claim 1, wherein the illumination arrangement is situated in a recess of the base body element.

13. The handheld tool storage device of claim 1, wherein the at least one handheld machine tool and/or accessories for the handheld machine tool is situated for transport and/or for storage in the accommodation region.

14. The handheld tool storage device of claim 13, wherein the accommodation region includes accommodation elements, which are provided to accommodate the at least one handheld machine tool and/or the accessories for the handheld machine tool at least partially in a form-locking manner.

15. A handheld tool storage device, comprising:

at least one base body unit, which includes at least one movably supported base body element that is configured as a carrying case cover and a carrying case base body including an accommodation region for accommodating at least one handheld machine tool;

at least one electric functional unit; and at least one operating unit at least for operating the electric functional unit, wherein the operating unit has at least one operating element that is at a minimum distance from an axis of motion of the base body element, which is less than 50% of the main extension of the base body element, wherein the main extension of the base body element is the maximum extension of the base body element, which in a plane that includes the axis of motion, runs at least essentially parallel to the axis of motion, wherein:

an energy supply unit includes at least one energy store interface, which, along with at least one energy store device embodied as a battery pack for a handheld machine tool, is connectable to form an energy supply of the electric functional unit that is network-independent at least in an operating state, the energy store interface is at a minimum distance from the axis of motion of the base body element, which is less than 50% of a main extension of the base body element, the operating element is situated on an outer surface of the base body element that faces away from an inner surface of the base body element at which the energy store interface is situated on the base body element such that the battery pack connected to the energy store interface is disposed in the accommodation region, wherein the operating element is separated from the energy store interface by the base body element, and the operating element is situated on opposite sides of the base body element in relation to the energy store interface, an imaginary straight line runs at least essentially perpendicular to the outer surface of the base body element and intersects the operating element and the energy store interface, the electric functional unit is configured as an illuminating unit having an illumination arrangement, the illumination arrangement is situated in a recess of the outer surface of the base body element, and the illumination arrangement comprises an illumination area that is essentially perpendicular to the outer surface of the base body element.

16. The handheld tool storage device of claim 5, wherein the illumination unit comprises a pane that covers the illumination arrangement in a protective manner.

17. The handheld tool storage device of claim 1, wherein a plane running perpendicular to the axis of motion of the base body element intersects the at least one operating element and the at least one energy store interface.

* * * * *